US005146634A

United States Patent [19]

Hunt

[11] Patent Number: 5,146,634

[45] Date of Patent: Sep. 15, 1992

[54] THREE ZONE BED COVER WITH AN INFLATABLE HUMAN FORM

[76] Inventor: Lewis Hunt, P.O. Box 111, 6 E. Lynn St., New Lisbon, Ind. 47366

[21] Appl. No.: 757,639

[22] Filed: Sep. 11, 1991

[51] Int. Cl.[5] ..... A47G 9/00

[52] U.S. Cl. ..... 5/486; 5/502; 5/449

[58] Field of Search ..... 5/486, 482, 502, 413, 5/449, 485, 464; 2/64.5; 446/220, 226, 223

[56] References Cited

U.S. PATENT DOCUMENTS

| | | | |
|---|---|---|---|
| 2,064,458 | 12/1936 | Bulpit | 5/413 |
| 3,541,620 | 11/1970 | Chapuis | 5/502 |
| 3,584,323 | 6/1971 | Worley | 5/413 |
| 4,132,262 | 1/1979 | Wibell | 5/482 |
| 4,513,461 | 4/1985 | Tardivel | 5/413 |
| 4,750,225 | 6/1988 | Simons | 5/502 |
| 4,839,934 | 6/1989 | Rojos | 5/486 |
| 4,890,347 | 1/1990 | Fuller | 5/482 |
| 5,007,125 | 4/1991 | Owenby | 5/482 |

FOREIGN PATENT DOCUMENTS

| | | | |
|---|---|---|---|
| 6247 | 1/1980 | European Pat. Off. | 5/502 |
| 3305507 | 8/1984 | Fed. Rep. of Germany | 5/486 |
| 3500497 | 7/1986 | Fed. Rep. of Germany | 5/502 |
| 442583 | 2/1936 | United Kingdom | 5/502 |
| 2229086 | 9/1990 | United Kingdom | 5/502 |

*Primary Examiner*—Renee S. Luebke
*Assistant Examiner*—F. Saether
*Attorney, Agent, or Firm*—Hugh E. Smith

[57] ABSTRACT

Sleeping bags and bed covers are provided with selectively designed heat retention comfort zones so as to provide variable degrees of warmth along the length of a user. The covers provide light insulation between a user's hips and shoulders, medium insulation between the hips and knees, and heavy insulation between the knees and feet. In an alternative embodiment, an inflatable body form may be provided to give the appearance of someone sleeping beneath the cover to provide greater security from intruders.

4 Claims, 4 Drawing Sheets

THREE ZONE BED COVER WITH AN INFLATABLE HUMAN FORM

BACKGROUND OF THE INVENTION

1. Field of the Invention

The present invention relates to heat insulating covers and more particularly pertains to an improved heat insulating blanket which may be utilized as a bed cover or sleeping bag.

2. Description of the Prior Art

The use of heat insulating bed covers is known in the prior art. Typical examples of well designed thermal insulating blankets are to be found in U.S. Pat. No. 4,915,998, which issued to Parenti, Jr. et al. on Apr. 10, 1990, and U.S. Pat. No. 4,927,705, which issued to Syme et al. on May 22, 1990. The Parenti, Jr. et al. patent discloses a thermal insulation blanket which utilizes a plurality of goldized film layers having interleaved ceramic fiberglass cloth layers, thereby to provide insulation against radiated heat loss in a space environment. Adjacent to the goldized layer is a felt or foam mat which provides insulation against conduction or convection heat loss in the ambient environment. As can be appreciated, this patent clearly teaches the use of multiple layers of various materials to achieve a heat insulating effect.

By the same token, the Syme et al. patent discloses an insulating laminate which, in part, discloses a compressible polyester blanket bonded directly at one surface to a polymer surface of a vapor barrier formed by a metallized moisture and impermeable, polymer film. Again there is provided the teaching of using multiple layers of different materials to achieve a heat insulating effect. However, both of these above-described patents do not take into account different heat insulating requirements of a user's body. More specifically, the body heat distribution for most people is greater in an upper area of their body and less in their legs and feet, whereby it might be desireable to provide an insulating cover that provides variable degrees of insulation over a human body. As such, it would appear that there exists a continuing need for new and improved heat insulating covers which could function to overcome this uneven heat distribution problem and in this regard, the present invention substantially fulfills this need.

SUMMARY OF THE INVENTION

In view of the foregoing disadvantages inherent in the known types of heat insulating blankets now present in the prior art, the present invention provides an improved heat insulating blanket construction wherein the same can be utilized as a bed cover, a sleeping bag, or the like. As such, the general purpose of the present invention, which will be described subsequently in greater detail, is to provide a new and improved heat insulating blanket which has all the advantages of the prior art heat insulating blankets and none of the disadvantages.

To attain this, the present invention essentially consists of sleeping bags and bed covers which are provided with variable heat retention comfort zones so as to provide variable degrees of warmth along the length of a user. The covers provide light insulation between a user's hips and shoulders, medium insulation between the hips and knees, and heavy insulation between the knees and feet. In an alternative embodiment, an in inflatable body form may be provided to give the appearance of someone sleeping beneath the cover to provide greater security from intruders.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved heat insulating blanket which has all the advantages of the prior art heat insulating blanket and none of the disadvantages.

It is another object of the present invention to provide a new and improved heat insulating blanket which may be easily and efficiently manufactured and marketed.

It is a further object of the present invention to provide a new and improved heat insulating blanket which is of a durable and reliable construction.

An even further object of the present invention is to provide a new and improved heat insulating blanket which is susceptible of a low cost of manufacture with regard to both materials and labor, and which accordingly is then susceptible of low prices of sale to the consuming public, thereby making such heat insulating blankets economically available to the buying public.

Still yet another object of the present invention is to provide a new and improved heat insulating blanket which provides in the apparatuses and methods of the prior art some of the advantages thereof, while simultaneously overcoming some of the disadvantages normally associated therewith.

Still another object of the present invention is to provide a new and improved heat insulating blanket which has variable layers of insulation so as to vary the heat insulating effect along a user's body.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
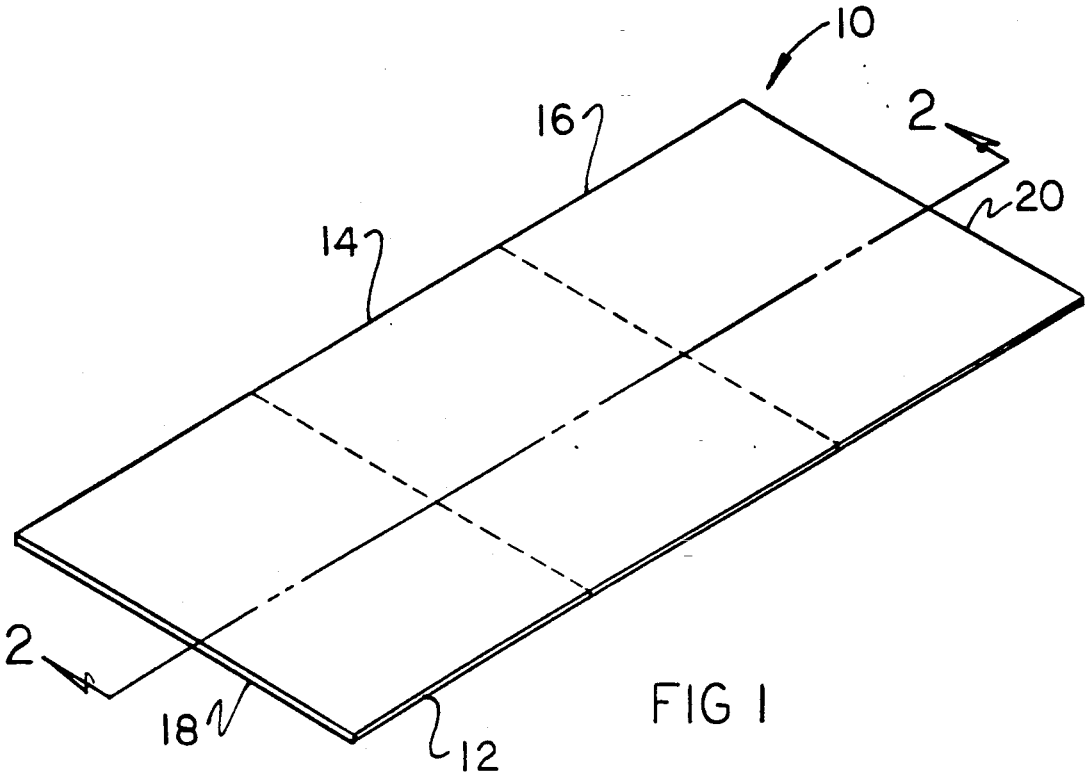
FIG. 1 is a perspective view of a first embodiment of heat insulating blanket comprising the present invention.

With reference now to the drawings, and in particular to FIG. 1 thereof, a new and improved heat insulating blanket embodying the principles and concepts of the present invention and generally designated by the reference numeral 10 will be described.

More specifically, it will be noted that the heat insulating blanket 10 is divided into three comfort zones 12, 14, 16. With the head of the blanket being defined by the numeral 18 and the foot of the blanket being defined by the numeral 20, the upper zone 12 is intended to cover an individual from his hips to his shoulders and utilizes a light insulation. The center zone 14 should cover a user from his hips to his knees and provides a medium insulation effect. The bottom zone 16 covers a user form his knees past his feet and provides a heavy insulation effect.

Figure 2:
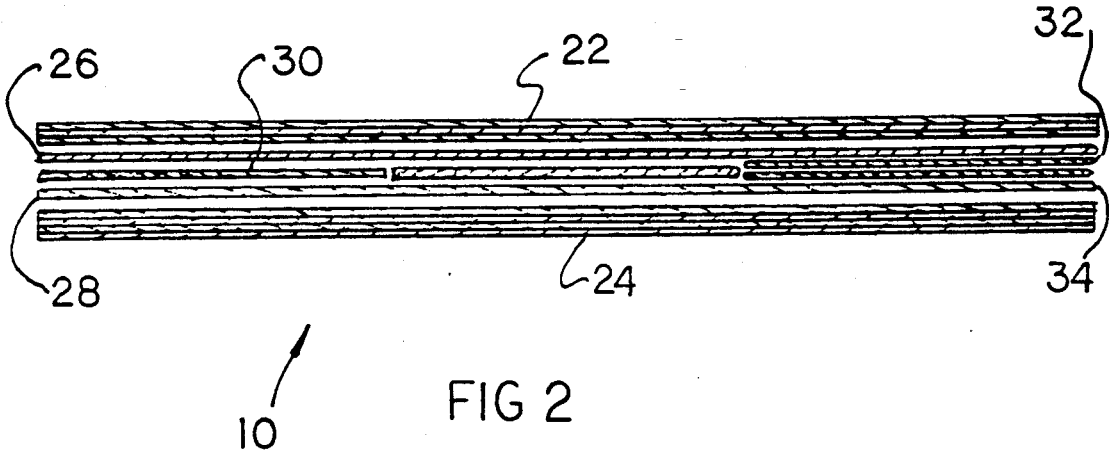
FIG. 2 is a cross-sectional view of the invention as viewed along the line 2—2 in FIG. 1.

To obtain these varying degrees of insulation effect, a multi-layered construction is utilized. With particular reference to FIG. 2 of the drawings, it will be seen that the blanket 10 in one preferred embodiment is provided with a multi-layered quilted top 22 and a multi-layered backing stock 24. Several layers of material as will be subsequently described are then fixedly secured between the quilted top 22 and the backing stock 24. A first layer of dacron or down filler 26 is fixedly secured, such as by sewing or the like, to a bottom portion of the quilted top 22 and a second layer of dacron or down filler 28 is then sewed to a top portion of the backing stock 24. The three afore-described comfort zones 12, 14, 16 are then developed between the filler layers 26, 28. The light insulation zone 12 is created by the insertion of an insulating fabric 30. This insulating fabric could consist of any known insulating material which is generally suitable for the intended purpose.

The second comfort zone 14 is then developed by the insertion of a heavier insulating fabric between the filler layers 26, 28. The third comfort zone 16 is developed by the insertion of two light insulating fabrics 32, 34 between the filler layers 26, 28. In the preferred embodiment, the layer of material 30 could be doubled to achieve the same result in the comfort zone 16 ,i.e., the two layers 32, 34 could essentially consist of the same material 30 used in the comfort zone 12.

Figure 3:
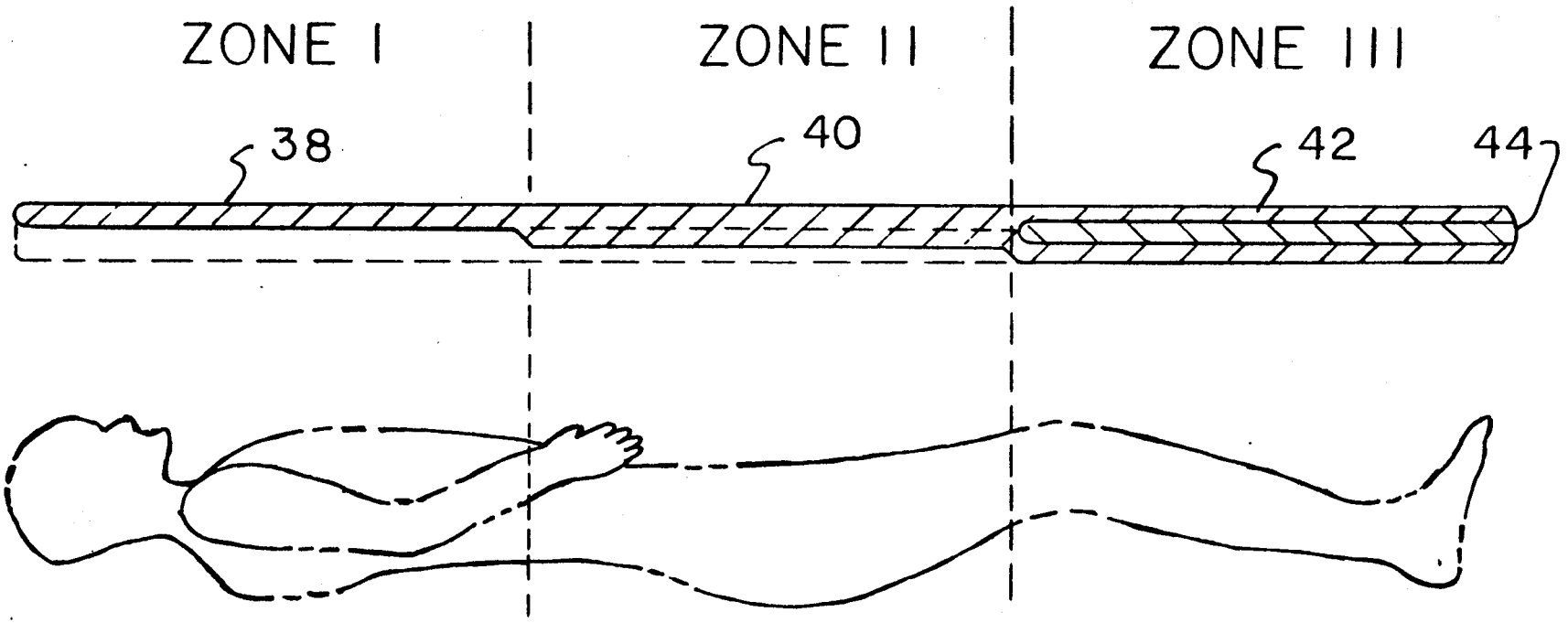
FIG. 3 is a side elevation view of a second embodiment of the invention.

A modified embodiment of the invention is shown in FIG. 3 and is generally designated by the reference numeral 36. More specifically, the blanket 36 shown in FIG. 3 also is provided with three comfort zones 38, 40, 42. As opposed to using a multiplicity of layers of different materials, the blanket 36 uses a light insulation material in the first zone 38, and that material is effectively doubled in thickness in the second zone 40. The third zone 42 includes the same double thickness material used in zone 40; however, an additional layer of material 44 is inserted between the double layer construction. This layer 44 consists of a heat reflecting type of cloth such as aluminum laminated polyethylene. Aluminum laminated polyethylene 44 reflects body heat while being very thin (approximately 0.001 inch in thickness). In contrast, the material utilized in zones 38, 40 may range anywhere from a ¼ inch in thickness to 2½ inches. This heat reflective aluminum laminated material could be affixed to the zones 38, 40 if desired.

Figure 4:
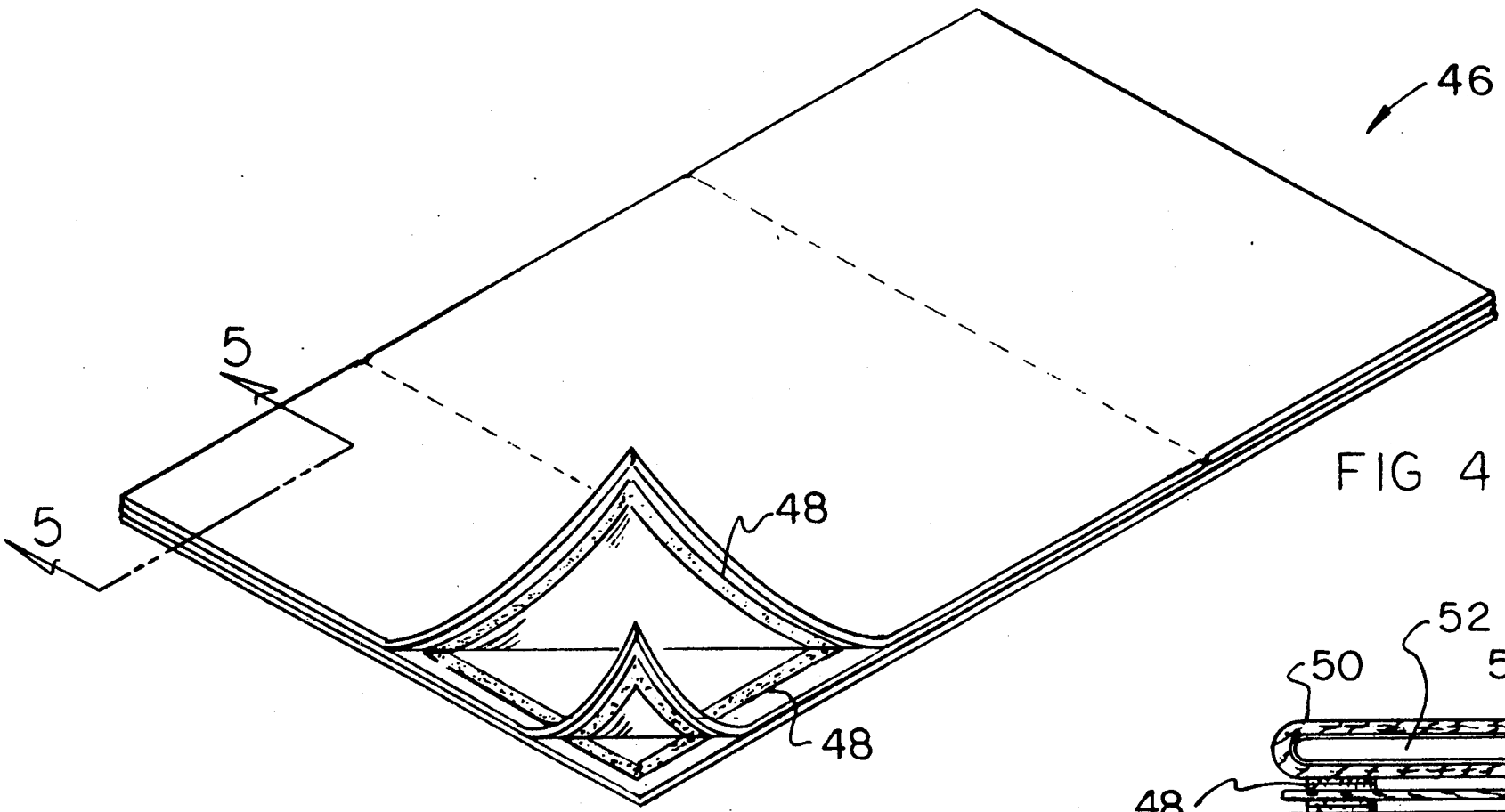
FIG. 4 is a perspective view of a third embodiment of the invention.
Figure 5:
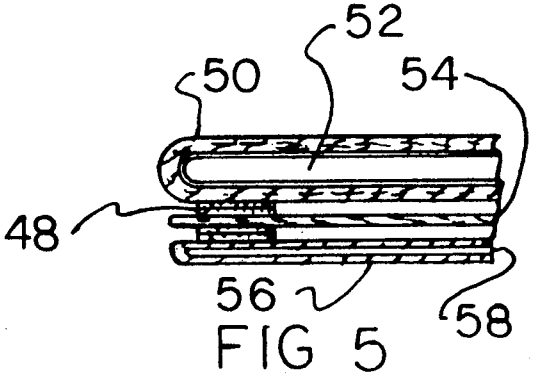
FIG. 5 is a cross-sectional view of the third embodiment of the invention as viewed along the line 5—5 in FIG. 4.

FIGS. 4 and 5 of the drawings illustrate a further modified embodiment of the invention which is generally designated by the reference numeral 46. Generally speaking, the multi-zoned comforter shown in this embodiment utilizes a hook and loop fastener material 48 to effectively remove and attach different layers of material as desired. Additionally, as best shown in FIG. 5, a topmost layer 50 may be of an inflatable design and includes an interior hollow chamber 52 that may be pressurized to a desired thickness by an appropriate supply of a gaseous fluid. A multiplicity of insulating materials 54 may be attached to a medium bottommost portion of the layer 50, and a bottom layer 56 may also include a pressurizable chamber 58 to again adjust the temperature insulating properties. Where a plurality of segments 50, 56 are utilized, they could be pressurized to different thicknesses so as to vary the heat insulating qualities of the blanket 46 and to thus achieve the multi-zone comfort requirements illustrated in the principle embodiment 10 of the invention.

Figure 6:
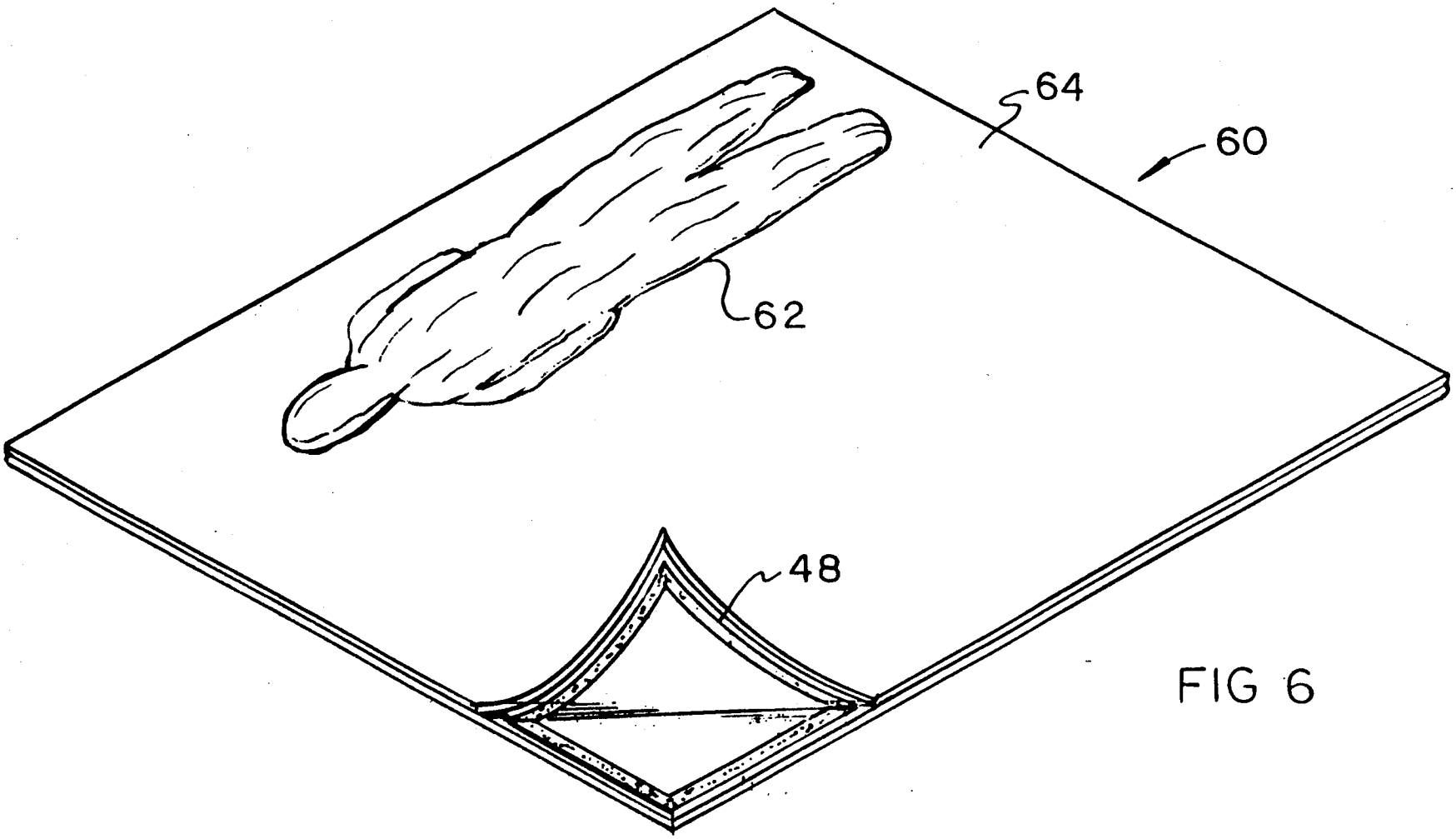
FIG. 6 is a perspective view of a fourth embodiment of the invention.

FIG. 6 of the drawings illustrates a final embodiment of the invention which is generally designated by the reference numeral 60. The comforter 60 again illustrates the use of a hook and loop fastening material 48 whereby a plurality of layers may be added or removed as desired. Further, an inflatable portion 62 formed in one side of the blanket 60 is shaped as a human form. As such, a blanket 60 may be used to cover a bed and when the human form 62 is inflated, it gives the appearance that someone is asleep in the associated bed. This is particularly useful when the inflatable human form 62 is positioned below the topmost layer 64 of the blanket 60, and the simulated appearance of a sleeping person provides some degree of security against intruders.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A new and improved heat insulative covering for use as a comforter, blanket or sleeping bag, said heat insulative covering comprising:

a first length portion formed from a light insulative material, said first length portion being formed at a first end of said covering;

a second length portion formed from a medium insulative material, said second length portion being formed at an intermediate portion of said covering;

a third length portion formed from a heavy insulative material, said third length portion being formed at a remaining free end of said covering; and an inflatable human form which is formed in a side of said covering.

2. The new and improved heat insulative covering for use as a comforter, blanket or sleeping bag as described in claim 1, wherein said covering includes a quilted top portion and a layered backing stock bottom portion.

3. The new and improved heat insulative covering for use as a comforter, blanket or sleeping bag as described in claim 1, and further including two layers of filler material positioned between said quilted top portion and said layered backing stock bottom portion.

4. The new and improved heat insulative covering for use as a comforter, blanket or sleeping bag as described in claim 1, and further including variable thicknesses of insulative material in each of said first length portion, said second length portion and said third length portion, thereby to achieve light, medium and heavy insulative effects.

* * * * *